US006077049A

United States Patent [19]

Nakamura et al.

[11] Patent Number: 6,077,049

[45] Date of Patent: Jun. 20, 2000

[54] DOUBLE-HEADED PISTON TYPE COMPRESSOR

[75] Inventors: Masaya Nakamura; Hisato Kawamura; Tetsuya Yamaguchi; Motonobu Kawakami; Hayato Ikeda, all of Kariya, Japan

[73] Assignee: Kabushiki Kaisha Toyoda Jidoshokki Seisakusho, Kariya, Japan

[21] Appl. No.: 08/936,930

[22] Filed: Sep. 25, 1997

[30] Foreign Application Priority Data

Sep. 30, 1996 [JP] Japan ..... 8-258752

[51] Int. Cl.[7] ..... F04B 27/08

[52] U.S. Cl. ..... 417/269; 417/312; 91/499; 92/71

[58] Field of Search ..... 417/269, 312, 417/540; 91/499; 92/71, 78; 184/6.17

[56] References Cited

U.S. PATENT DOCUMENTS 4,610,604 9/1986 Iwamori ..... 417/269
5,139,392 8/1992 Pettitt et al. ..... 417/312

FOREIGN PATENT DOCUMENTS 60-84779 6/1985 Japan .
3-67070 3/1991 Japan ..... 417/269

*Primary Examiner*—Timothy S. Thorpe
*Assistant Examiner*—Cheryl J. Tyler
*Attorney, Agent, or Firm*—Woodcock Washburn Kurtz Mackiewicz & Norris LLP

[57] ABSTRACT

A compressor has an odd number of aligned pairs of cylinder bores. A double-headed piston is accommodated in each aligned pair of bores. The time at which gas is discharged from each cylinder bore is different from that of all of the other cylinder bores. The compressor has a pair of reducing devices, one reducing the pulsation amplitude of the gas discharged from the front cylinder bores and the other reducing the pulsation amplitude of the gas discharged from the rear cylinder bores. The reducing devices reduce the gas pulsation amplitudes of the front and rear cylinder bores at a substantially equal rate. Each reducing device includes a discharge chamber for receiving the gas discharged from the associated cylinder bores and a discharge passage connected to the discharge chamber. The discharge chambers of the reducing devices have equal volumes, and the discharge passages of the reducing devices have equal lengths and equal cross-sectional areas. This structure improves the vibration characteristics of the compressor and thus reduces noise.

18 Claims, 8 Drawing Sheets different decrease rates of discharge pulsation amplitudes in front and rear ends

DOUBLE-HEADED PISTON TYPE COMPRESSOR

BACKGROUND OF THE INVENTION

The present invention relates to double-headed piston type compressors used in vehicle air conditioners. More particularly, the present invention pertains to a structure for suppressing discharge pulsations of refrigerant gas.

A typical double-headed piston type compressor has a drive shaft supported in a housing. The housing includes a pair of front and rear cylinder blocks secured to each other and front and rear housings. The front housing is coupled to the front end of the front cylinder block with a valve plate arranged in between. In the same manner, the rear housing is coupled to the rear end of the rear cylinder block with a valve plate arranged in between. A crank chamber is defined between the cylinder blocks. Further, suction and discharge chambers are defined in each of the front and rear housings. The cylinder blocks also include a plurality of cylinder bores. Each bore in the front cylinder block is aligned with one of the bores in the rear cylinder block. A double-headed piston is reciprocally housed in each pair of cylinder bores. Compression chambers are defined in each cylinder bore between the end of the piston and corresponding valve plates. The number of cylinder bores is represented by n, and the number of compression chambers in each of the front and rear cylinder blocks is also represented by n. A swash plate is fixed to the drive shaft and rotates integrally with the shaft. Rotation of the swash plate is converted into linear reciprocation of each piston. The reciprocation of each piston compresses the refrigerant gas in each compression chamber.

During operation of the compressor, compressed refrigerant gas is constantly discharged from the compression chambers to the discharge chambers. The pressure in each discharge chamber is momentarily increased every time refrigerant gas is discharged thereto from one of the compression chambers. This periodically pulsates the pressure in the discharge chambers thereby generating so-called discharge pulsation. When analyzing the discharge pulsation using a fast Fourier transform (FFT), it is apparent that the pulsation includes a wide variety of frequency components ranging from zero cycles to a large number of cycles. Among the frequency components, the main component is the n-cycle component, which corresponds to the number n of the cylinder bores. The n-cycle component corresponds to the vibration component that occurs n times during one rotation of the drive shaft. When the compressor is operated at a normal speed, the n-cycle frequency component tends to be close to the natural frequencies of various auxiliary devices, such as an alternator, which are coupled to the compressor by a belt. In this case, resonance occurs in the auxiliary devices and thus noise in the passenger compartment is increased.

Japanese Unexamined Utility Model Publication No. 60-84779 discloses a compressor having a structure for suppressing discharge pulsation. In this compressor, the proximal end of a pipe is connected to each of the front and rear discharge chambers. The pipes have substantially the same length. Openings at the distal ends of the pipes face each other in the cylinder block.

In this compressor, discharge pulsation is suppressed by equalizing the lengths of the two pipes, which function as discharge passages, and by causing the refrigerant gas streams discharged from the pipes to collide with each other. However, the apparatus of this publication does not suppress the n-cycle frequency component, which is the main cause of vibration and noise.

If the rate of decrease in the amplitude of the pulsation of refrigerant gas discharged from the front compression chambers is different from that of refrigerant gas discharged from the rear compression chambers as shown in FIG. 7(*b*), the n-cycle frequency component is not sufficiently suppressed. In the compressor of the above publication, refrigerant gas discharged from the two pipes (discharge passages) is merged in a chamber such as a discharge muffler before flowing out to an external refrigerant circuit. The phase of the n-cycle frequency components in the refrigerant gas discharged from one of the pipes is different from the phase of the n-cycle frequency components in the refrigerant gas discharged from the other pipe. The difference of the decrease rates of pulsations causes the amplitudes of n-cycle frequency components to be different in the refrigerant gas discharged from the two pipes. In this case, two n-cycle frequency components having different phases and different amplitudes exist in the pulsation of refrigerant gas in the single chamber. Therefore, the compressor of the above publication cannot adequately suppress the n-cycle frequency component.

SUMMARY OF THE INVENTION

Accordingly, it is an objective of the present invention to provide a double-headed piston type compressor that reduces the n-cycle frequency component and thus operates more quietly with reduced vibration.

To achieve the above objective, the compressor according to present invention has a drive shaft, a drive plate mounted on the drive shaft, a plurality of first cylinder bores arranged around the drive shaft, and a plurality of second cylinder bores arranged around the drive shaft in corresponding alignment with the first cylinder bores. Each second cylinder bore forms an aligned pair with a corresponding first cylinder bore. A plurality of pistons are operably connected to the drive plate. Each piston is accommodated in one of the aligned pairs of cylinder bores. The drive plate converts the rotation of the drive shaft to reciprocation of the pistons. Each piston compresses and discharges gas supplied to the associated first and second cylinder bores. The time at which gas is discharged from each cylinder bore is different from that of all of the other cylinder bores. The compressor has reducing means for reducing the pulsation amplitudes of the gas discharged from both of the first and second cylinder bores at a substantially equal rate.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings.

FIG. 7(*b*) is a series of diagrammatic wave form charts illustrating a situation where the rates of decrease of the amplitudes of the discharge pulsations are different between the front end and the rear end of a compressor;

DETAILED DESCRIPTION OF THE PREFERRED EMBODIMENTS

A first embodiment of the present invention will now be described with reference to FIGS. 1 to 7.

Figure 1:
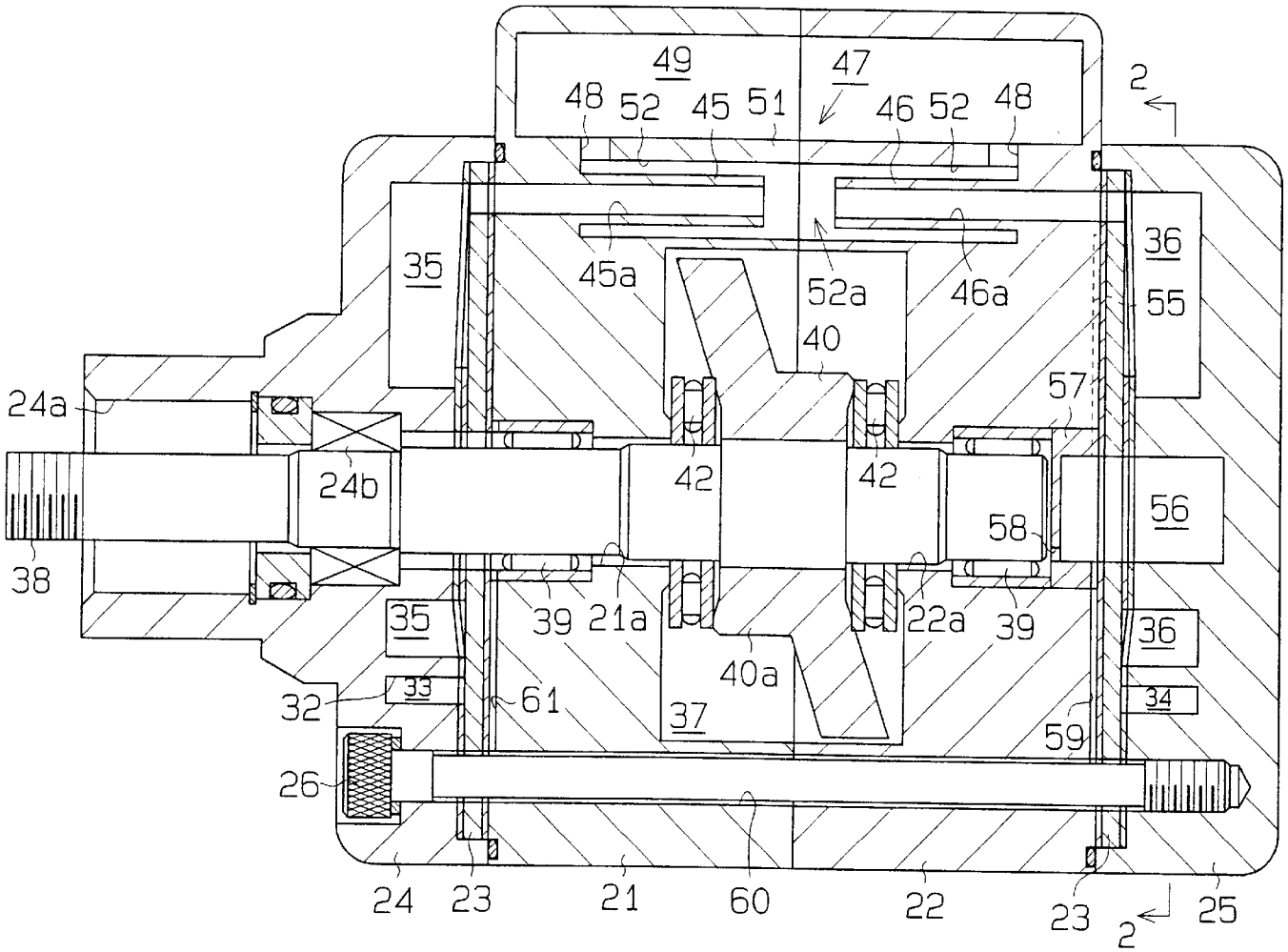
FIG. 1 is a cross-sectional view showing a compressor according to a first embodiment of the present invention taken along line 1—1 of FIG. 2.
Figure 3:
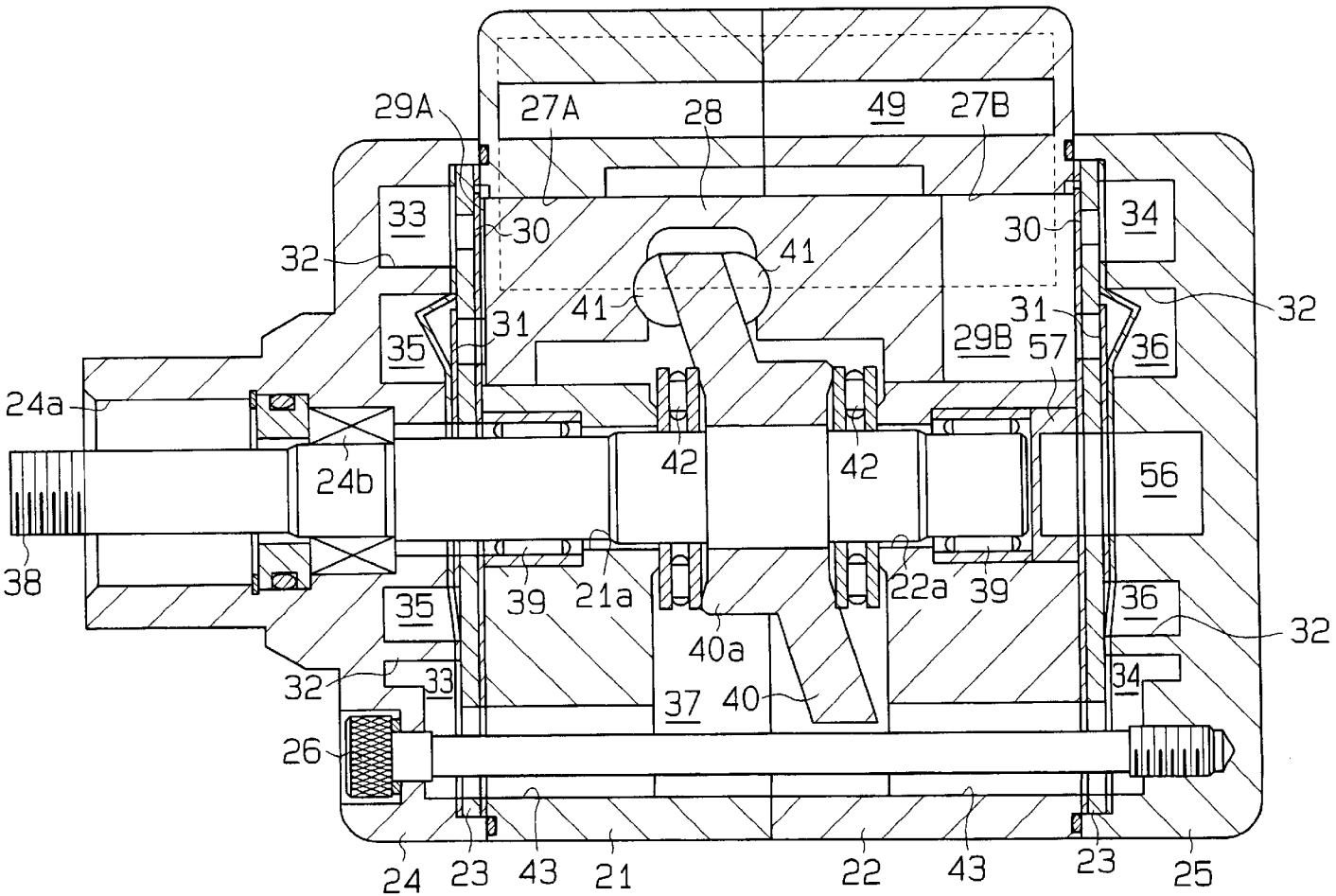
FIG. 3 is a cross-sectional view taken along line 3—3 of FIG. 2.

As shown in FIGS. 1 and 3, the rear end of a front cylinder block 21 is coupled to the front end of a rear cylinder block 22. A front housing 24 is coupled to the front end of the front cylinder block 21 with a valve plate 23 arranged therebetween. A rear housing 25 is coupled to the rear end of the rear cylinder block 22 with a valve plate 23 arranged therebetween. The cylinder blocks 21, 22, the housings 24, 25 and valve plates 23 are fastened to one another by a plurality of bolts 26 and constitute the housing of the compressor.

A crank chamber 37 is defined between the front and rear cylinder blocks 21, 22. A drive shaft 38 is rotatably supported by a pair of radial bearings 39 in shaft holes 21*a*, 22*a*, which are defined in the cylinder blocks 21, 22, respectively. The front end of the shaft 38 protrudes to from a hole 24*a* defined in the front housing 24. A lip seal 24*b* is located between the periphery of the shaft 38 and the inner surface of the hole 24*a* for sealing refrigerant gas in the crank chamber 37. The hole 24*a* communicates with the shaft hole 21*a*. The drive shaft 38 is operably coupled to and rotated by an external drive source such as a vehicle engine by way of a clutch (not shown).

Figure 4:
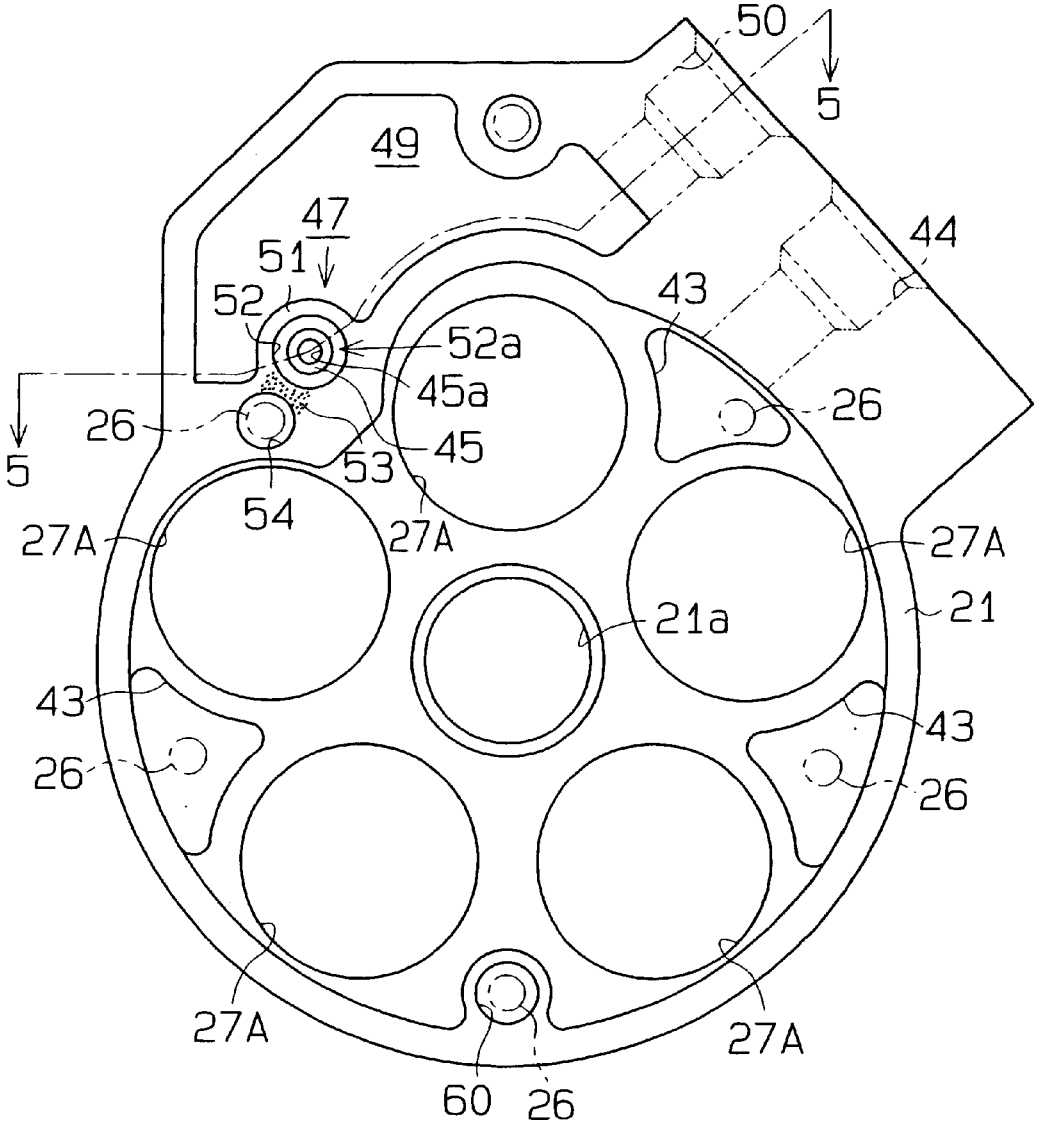
FIG. 4 is a rear view of the front cylinder block of FIG. 1.

As shown in FIGS. 3 and 4, an odd number (five in this embodiment) of parallel cylinder bores 27A extend through the front cylinder block 21 while an equal number of parallel cylinder bores 27B extend through the rear cylinder block 22. The cylinder bores 27A are aligned with the cylinder bores 27B, and the aligned pairs of the cylinder bores 27A and 27B are spaced apart at equal intervals about the axis of the drive shaft 38. A double-headed piston 28 is accommodated in each aligned pair of cylinder bores 27A and 27B. Compression chambers 29A and 29B are defined between the valve plates 23 and front and rear end faces of the pistons 28 in the cylinder bores 27A and 27B, respectively. The compressor of this embodiment is a ten cylinder type compressor having five front compression chamber 29A and five rear compression chambers 29B. The discharge timing of refrigerant gas is different in each of ten compression chambers 29A, 29B.

Figure 2:
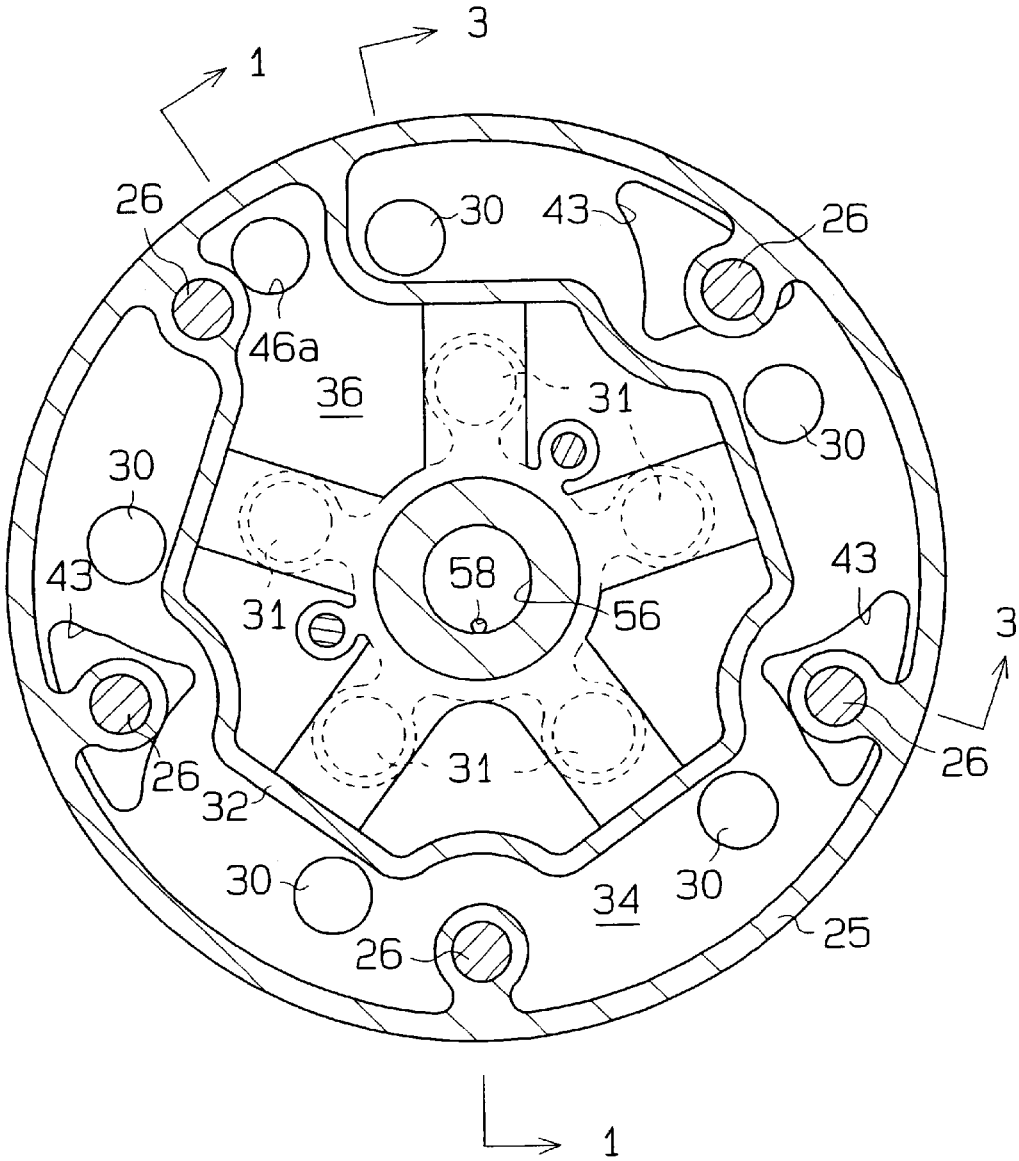
FIG. 2 is a cross-sectional view taken along line 2—2 of FIG. 1.

As shown in FIGS. 2 and 3, suction chambers 33, 34 are defined in radially outer parts of the front and rear housings 24, 25. Discharge chambers 35, 36 are located radially inward of the suction chambers 33, 34, respectively. Generally annular bulkheads 32 are defined in the front and rear housings 24, 25, respectively, for separating the suction chambers 33, 34 from the discharge chambers 35, 36.

Suction valve mechanisms 30 and discharge valve mechanisms 31 are formed on the valve plates 23 to correspond to each of the cylinder bores 27A and 27B. Each suction valve mechanism 30 includes suction ports that communicate the compression chambers 29A, 29B with the suction chambers 33, 34 and valve flaps for selectively opening and closing the suction ports. Each discharge valve mechanism 31 includes discharge ports that communicate the compression chambers 29A, 29B with the discharge chambers 35, 36 and valve flaps for selectively opening and closing the discharge ports.

As shown in FIG. 3, a swash plate 40 is fixed to the middle of the drive shaft 38 and connected to the middle of each piston 28 by a pair of semispheric shoes 41. The swash plate 40 converts rotation of the drive shaft 38 into reciprocation of the pistons 28 in the associated pair of the cylinder bores 27A, 27B. Thrust bearings 42 are arranged between the front and rear surfaces of a boss 40*a* defined on the swash plate 40 and the opposed inner walls of the front and rear cylinder blocks 21, 22. The axial load acting on the swash plate 40 is carried by the cylinder blocks 21, 22 via the thrust bearings 42.

As shown in FIGS. 1 to 5, suction passages 43 are defined in the cylinder blocks 21, 22 to connect the suction chambers 33, 34 with the crank chamber 37. An inlet 44 is formed in the upper portion of the cylinder block 22 for connecting the crank chamber 37 with an external refrigerant circuit (not shown). An oil separator 47 and a discharge muffler 49 are formed on top of the cylinder blocks 21, 22. Discharge passages 45*a*, 46*a* are defined in the valve plates 23 and the cylinder blocks 21, 22 for connecting the discharge chambers 35, 36 with the oil separator 47. An outlet 50 is formed in the upper portion of the cylinder block 22 for connecting the discharge muffler 49 with the external refrigerant circuit.

The oil separator 47 will now be described. Holes 52 having a circular cross-section are defined in the cylinder blocks 21 and 22 parallel to the axis of the drive shaft 38. The holes 52 are aligned with each other and define an oil separating chamber 52*a*. Oil separating cylinders 45 and 46 are formed integrally with the cylinder blocks 21, 22 and project inward from ends of the holes 52 toward the boundary of the cylinder blocks 21, 22 (see FIG. 5). Parts of the discharge passages 45*a*, 46*a* are defined in the separating cylinders 45, 46. The outlets of the discharge passages 45*a*, 46*a* open at the distal ends of the cylinders 45, 46 in the holes 52 (in other words, in the oil separating chamber 52*a*) and are arranged close to each other and oppose each other. The cylinders 45, 46 and the passages 45*a*, 46*a* extend parallel to the axis of the drive shaft 38 and are axially aligned with each other.

Figure 5:
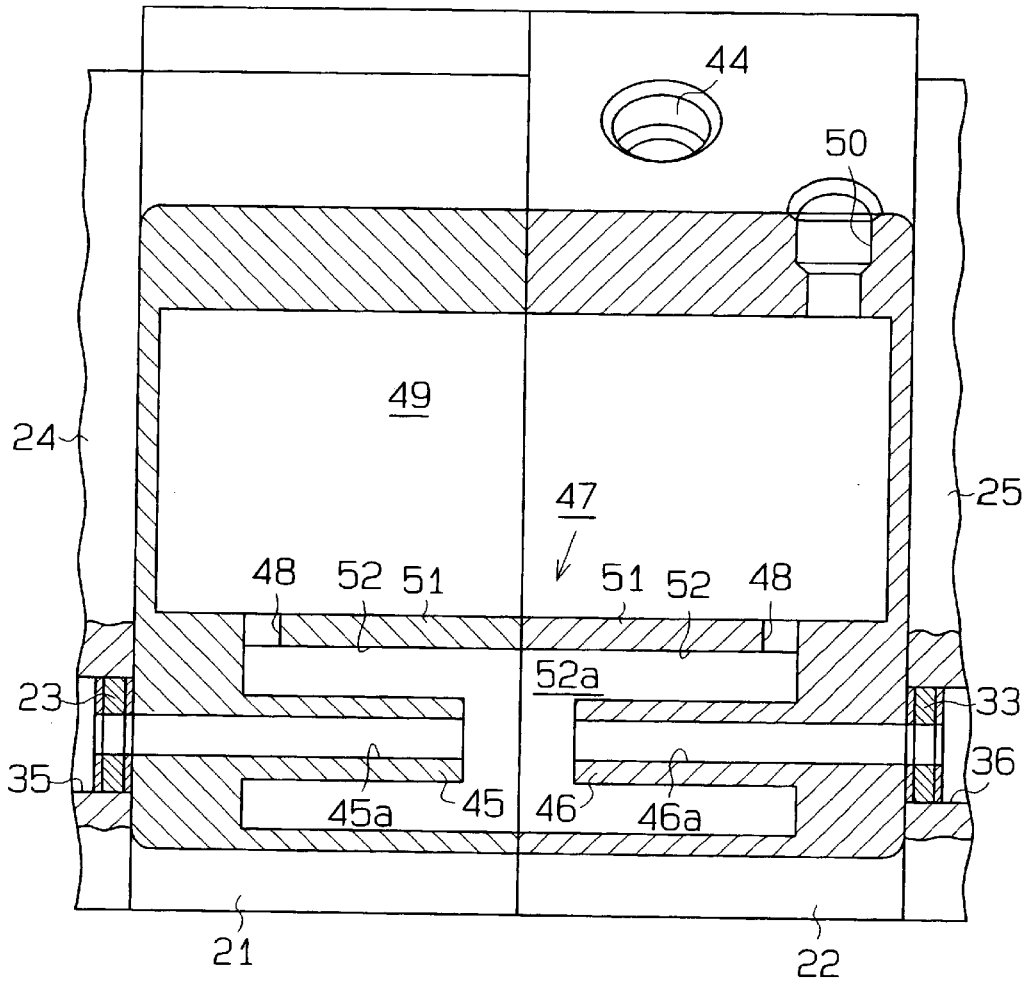
FIG. 5 is a cross-sectional view taken along line 5—5 of FIG. 4.

Communicating holes 48 are formed in bulkheads 51, which separate the oil separating chamber 52*a* from the discharge muffler 49. The holes 48 are located at positions corresponding to the proximal ends of the separating cylinders 45, 46 as shown in FIGS. 5 and 1. The oil separating chamber 52*a* is communicated with the discharge muffler 49 by the communication holes 48.

The discharge chambers 35, 36 and the discharge passages 45*a*, 46*a* function to suppress the pressure pulsations of refrigerant gas discharged from the compression chambers 29A, 29B. In this embodiment, the front discharge chamber 35 has the same volume as the rear discharge chamber 36. Further, the length and the cross-sectional area of the front discharge passage 45*a* are equal to those of the rear discharge passage 46*a*.

For example, if the displacement of the compressor is about between 100 cc and 200 cc, the volume of each discharge chamber 35, 36 is preferably from 20 cc to 100 cc, and more preferably from 60 cc to 80 cc. The length of each passage 45*a*, 46*a* is preferably from 13 mm to 60 mm, and more preferably from 40 mm to 50 mm. The diameter of each discharge passage 45*a*, 46*a* is preferably from 7 mm to 12mm, and more preferably from 4 mm to 6 mm. Also in this case, the distance between the distal ends of the separating cylinders 45, 46 is preferably from 3 mm to 20 mm, and more preferably from 5 mm to 8 mm.

As shown in FIG. 4, a rough surface 53 is formed on the rear end face of the front cylinder block 21 or the front end face of the rear cylinder block 22 (or on both surfaces) between the oil separating chamber 52*a* and a first bolt hole 54 that is closest to the chamber 52*a*. The rough surface 53 (FIG. 4) forms a small clearance between the cylinder blocks 21 and 22 by which the oil separating chamber 52*a* is communicated with the first bolt hole 54. The diameter of the first bolt hole 54 is greater than the diameter of the bolt 26 that extends through the hole 54. Thus, the annular clearance between the first bolt hole 54 and the bolt 26 forms a conduit for oil.

A cylindrical sleeve 57 having a closed end is fitted in the shaft hole 22*a* of the rear cylinder block 22. An oil storing chamber 56 is defined by the inner wall of the sleeve 57, the central portion of the rear valve plate 23 and the rear housing 25. The first bolt hole 54 is communicated with the oil storing chamber 56 by a first oil supplying groove 55 formed in the rear end face of the rear cylinder block 22. The storing chamber 56 is communicated with the shaft hole 22*a* in the rear cylinder block 22 by a hole 58 formed in the sleeve 57. Therefore, the storing chamber 56 is communicated with the crank chamber 37 by the hole 58 and the radial bearing 39 located in the shaft hole 22*a*. That is, oil can pass through the radial bearing 39.

Further, the storing chamber 56 is communicated with a second bolt hole 60, which is located at the lowest position in the cylinder blocks 21, 22 by a second oil supplying groove 59 formed in the rear end face of the rear cylinder block 22. An annular clearance between the second bolt hole 60 and the bolt 26 that extends through the hole 60 permits the flow of oil (as shown in FIG. 4). The second bolt hole 60 is communicated with the shaft hole 21*a* defined in the front cylinder block 21 by a third oil supplying groove 61 formed on the front end face of the front cylinder block 21. Thus, the oil storing chamber 56 is communicated with the shaft hole 21*a* in the front cylinder block 21 as well as with the shaft hole 22*a* in the rear cylinder block 22.

The operation of the above described double-headed piston type compressor will hereafter be described.

When the drive shaft 38 is rotated by an external drive source such as a vehicle engine, the rotation of the shaft 38 is converted into reciprocation of the pistons 28 in the cylinder bores 27A, 27B by way of the swash plate 40 and the shoes 41. The reciprocation of the pistons 28 draws refrigerant gas from the external refrigerant circuit into the crank chamber 37 through the inlet 44. The gas then flows into the suction chambers 33, 34 via the suction passage 43. During the suction stroke, in which the piston 28 moves from the top dead center to the bottom dead center, the pressure in the compression chambers 29A, 29B is lowered. The lowered pressure in the chambers 29A, 29B draws the refrigerant gas from the suction chambers 33, 34 into the compression chambers 29A, 29B via the suction valve mechanisms 30. During the compression stroke, in which the piston 28 moves from the bottom dead center to the top dead center, refrigerant gas is compressed in the compression chambers 29A, 29B until it reaches a certain pressure level. The compressed gas is discharged to the discharge chambers 35, 36 via the discharge valve mechanisms 31. The compressed gas in the discharge chambers 35, 36 is then led to the oil separating chamber 52*a* through the discharge chambers 45*a*, 46*a*.

Refrigerant gas discharged into the oil separating chamber 52*a* from the front discharge passage 45*a* collides with refrigerant gas discharged into the chamber 52*a* from the rear discharge passage 46*a*. The collision reverses the direction of the streams of the discharged gas. The gas then flows toward the holes 48 while rotating about the oil separating cylinders 45, 46. The centrifugal force of the gas rotation separates misted lubricant oil from the refrigerant gas. As a result, refrigerant gas containing no lubricant oil is discharged to the discharge muffler 49 from the separating chamber 52*a* through the holes 48. The compressed refrigerant gas in the muffler 49 is supplied to a condenser, an expansion valve and an evaporator (none of which are shown) located in the external refrigerant circuit through the outlet 50. The gas is then used for air conditioning in the passenger compartment of the vehicle.

The pressure of the compressed refrigerant gas in the separating chamber 52*a* is high. On the other hand, the oil storing chamber 56 is communicated with the low pressure gas (suction pressure) in the crank chamber 37 by the hole 58. The pressure difference between the separating chamber 52*a* and the storing chamber 56 causes oil that is separated from the refrigerant gas in the separating chamber 52*a* to flow into the storing chamber 56 through the passage created by the rough surface 53 between the cylinder blocks 21 and 22, the first bolt hole 54 and the first oil supplying groove 55. The oil is temporarily stored in the chamber 56. Oil in the chamber 56 is then supplied to the shaft hole 22*a* in the rear cylinder block 22 via the hole 58 in the sleeve 57 for lubricating and cooling the rear radial bearing 39. Oil in the storing chamber 56 is also supplied to the shaft hole 21*a* in the front cylinder block 21 via the second oil supplying groove 59, the second bolt hole 60 and the third oil supplying groove 61. The oil lubricates and cools the front radial bearing 39 and the lip seal 24*b*.

The compressor according to the embodiment of FIGS. 1 to 5 has five compression chambers 29A and five compression chambers 29B. Therefore, while the drive shaft 38 is rotated one turn, refrigerant gas is discharged from the compression chambers 29A, 29B to the discharge chambers 35, 36 five times. Every discharge of the gas momentarily increases the pressure in each discharge chamber 35, 36 thereby generating discharge pressure pulsation. When analyzing the discharge pulsation using a fast Fourier transform (FFT), it is apparent that the pulsation includes a wide variety of frequency components ranging from zero cycles to a large number of cycles. Among the frequency components, the main component is the five cycle component, which corresponds to the number (five) of the cylinder bores 29A, 29B on each of the front and rear sides. The five cycle component corresponds to the vibration component that cyclically occurs five times during one rotation of the drive shaft 38.

Refrigerant gas in each compression chamber 29A, 29B is compressed until it reaches a certain pressure level and is then discharged to the discharge chambers 35, 36, which have a predetermined volume, through the discharge valve mechanism 31. The gas discharged to the chambers 35, 36 expands a little. The expansion of the gas suppresses the five cycle component in the discharge pulsations.

Refrigerant gas in the discharge chambers 35, 36 flows into the separating chamber 52*a* via the discharge passages 45*a*, 46*a*, which have a predetermined length and a predetermined cross-sectional area. When the gas flows through the passages 45*a*, 46*a*, a throttling effect on the gas further suppresses the five cycle component in the discharge pulsation.

Refrigerant gas discharged from the front discharge passage 45*a* into the separating chamber 52*a* collides with refrigerant gas discharged from the rear discharge passage 46*a* into the chamber 52*a*. The collision reverses the flow direction of the refrigerant gas. The collision and the flow reversals further suppress the five cycle component in the discharge pulsation. Then the gas having the suppressed discharge pulsation is introduced into the discharge muffler 49 through the separating chamber 52*a* and the holes 48.

In the illustrated embodiment, the compressor has an odd number (five) of compression chambers 29A, 29B in each of the front and rear ends, and the five compression chambers 29A, 29B are spaced apart at equal angular intervals about the axis of the drive shaft 38. Therefore, every seventy-two-degree turn (360°/5) of the drive shaft 38 discharges refrigerant gas from one of the five compression chambers 29A into the discharge chamber 35 and from one of the five compression chambers 29B into the discharge chamber 36. In other words, the five cycle component in the discharge pulsation in one of the discharge chambers 35 or 36 reaches a peak every time the drive shaft 38 turns seventy two degrees. Further, when a given piston 28 reaches its top dead center in the associated front cylinder bore 27A, that piston 28 reaches its top dead center in the corresponding rear cylinder bore 27B after the shaft 38 turns 180°. In other words, when each front compression chamber 29A discharges gas, the corresponding rear compression chamber 29B subsequently discharges gas after the drive shaft 38 turns 180°. Thus, the phase of the five cycle component in the discharge pressure pulsation generated in the front discharge chamber 35 is delayed 180°with respect to the phase of the five cycle component in the discharge pressure pulsation generated in the rear discharge chamber 36. Further, time at which refrigerant gas is discharged is different for each one of the ten compression chambers 29A, 29B.

Figure 6:
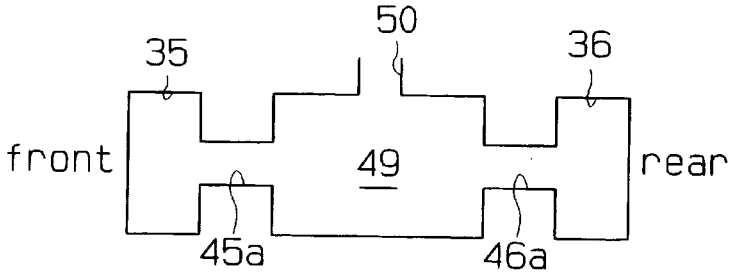
FIG. 6 is a diagrammatic view illustrating a mechanism for suppressing pulsation in the compressor of FIG. 1.
Figure 7A:
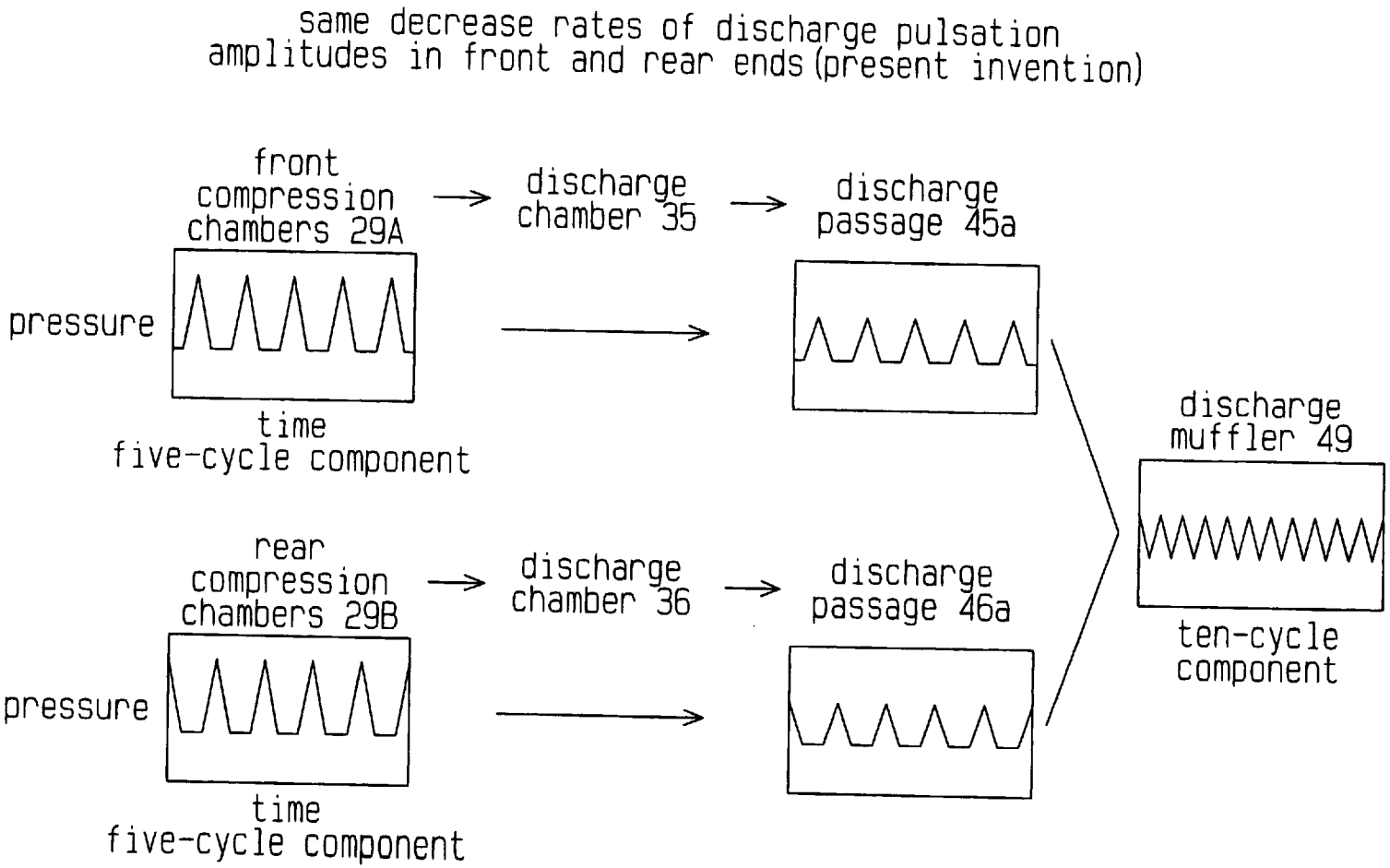
FIG. 7(*a*) is a series of diagrammatic wave form charts illustrating a time when the rates of decrease of the amplitudes of discharge pulsations are the same in the front end and the rear end of a compressor.
Figure 7B:
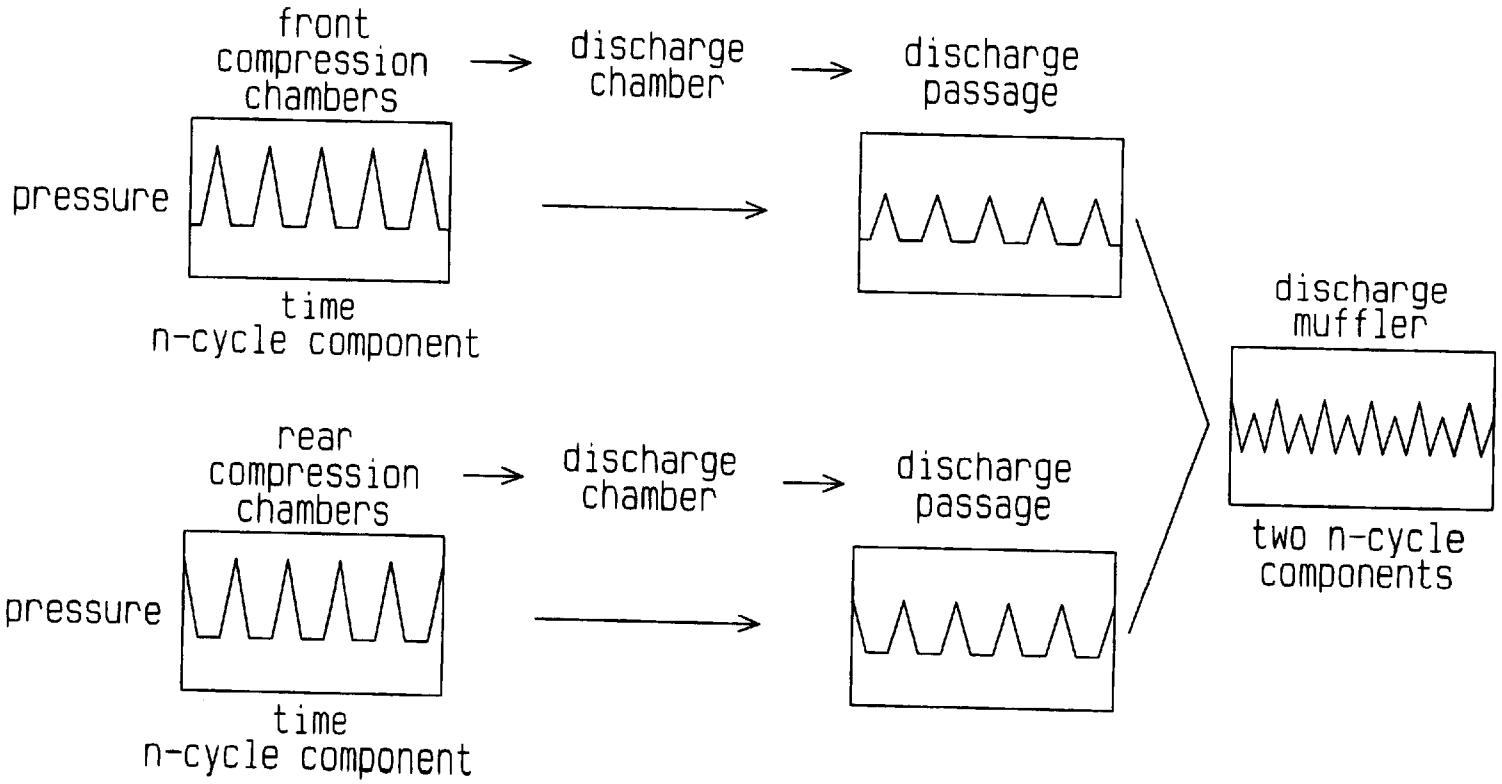

As shown in the diagram of FIG. 6, the volume of the front discharge chamber 35 is equal to the volume of the rear discharge chamber 36, and the length and the cross-sectional area of the front discharge passage 45*a* are equal to those of the rear discharge passage 46*a*. Therefore, the rate of decrease in the amplitude of the pressure pulsation of refrigerant gas discharged from the front compression chambers 29A is substantially equal to the rate of decrease in the amplitude of the pressure pulsation of refrigerant gas discharged from the rear compression chambers 29B. Thus, when refrigerant gas discharged from the front compression chambers 29A is merged with refrigerant gas discharged from the rear compression chambers 29B in the discharge muffler 49, the five cycle component in the discharge pressure pulsation of the refrigerant gas discharged from the front compression chambers 29A is substantially equal to the five cycle component in the discharge pressure pulsation of the refrigerant gas discharged from the rear compression chambers 29B.

Therefore, two five cycle components, which have peaks at every seventy-two-degree turn of the drive shaft 38 and which differ in phase by 180°, are merged in the discharge muffler 49. The two components have substantially the same amplitudes. A new ten-cycle component, which has peaks at every thirty-six-degree turn of the shaft 38, is then generated among the frequency components of pressure pulsation in the refrigerant gas in the discharge muffler 49. In other words, the five cycle components are converted to a ten cycle component.

As a result, vibration and noise caused by resonance of the compressor and various auxiliary components, such as an alternator, which are coupled to the compressor by a belt, are reduced. This makes the passenger compartment quieter. Incidentally, a pipe (not shown) connected to the outlet 50 tends to be resonated by discharge pressure pulsation, and the vibration of the pipe tends to be transmitted to the vehicle. However, the illustrated compressor eliminates the five cycle components in the frequency components of the pulsation thereby suppressing the vibration of the pipe.

The rates of decrease of the pressure pulsations in the front portion and rear portion of the compressor are equalized by simply equalizing the volumes of the front and rear discharge chambers 35, 36 and by equalizing the lengths and cross-sectional areas of the front and rear discharge passages 45*a*, 46*a*. Therefore, the five cycle components in the frequency components of the pulsation are suppressed by employing the simple construction of the illustrated compressor.

The outlets of the discharge passages 45*a*, 46*a* are close to and opposed to each other. This causes refrigerant gas streams discharged from the passages 45*a*, 46*a* to collide with each other regardless of the shapes of the oil separating chamber 52*a* and the discharge muffler 49 thereby reducing the five cycle components in the pulsations. After colliding with each other, the flow directions of refrigerant gas streams from the passages 45*a*, 46*a* are reversed. This further reduces the five cycle components in the pulsations.

The oil separator 47 is continuously formed with the discharge passages 45*a*, 46*a*. Lubricant oil contained in refrigerant gas discharged from the passages 45*a*, 46*a* to the separating chamber 52*a* is separated from the gas in the chamber 52*a*. The separated oil is supplied to and lubricates the radial bearings 39 and the lip seal 24*b*. This enhances the durability of the radial bearings 39 and the lip seal 24*b*.

Figure 8:
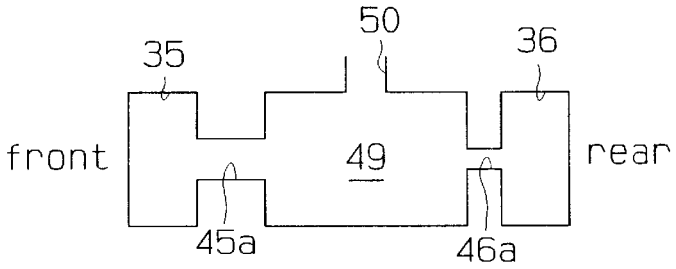
FIG. 8 is a diagrammatic view illustrating a mechanism for suppressing pulsation according to a second embodiment of the present invention.

The present invention may additionally take the following forms:

(1) FIG. 8 shows a second embodiment of the present invention. In this embodiment, the front discharge passage 45*a* is longer than the rear discharge passage 46*a*. Also, the cross-sectional area of the front discharge passage 45*a* is greater than that of the rear discharge passage 46*a*. The volume of the front discharge chamber 35 is equal to that of the rear discharge chamber 36.

The longer the discharge passage 45*a*, 46*a* is, or the smaller the cross-sectional area of the passage 45*a*, 46*a* is, the greater the throttle effect of the passage 45*a*, 46*a* becomes and the greater the rate of decrease of the amplitude of the pressure pulsation becomes. Therefore, in the second embodiment illustrated in FIG. 8, the rate of decrease of the amplitude of the pressure pulsation, when gas passes through the front discharge passage 45*a*, is substantially equal to the rate of decrease of the amplitude of the pulsation when gas passes through the rear discharge passage 46*a*.

Therefore, the rate of decrease of the pulsation amplitude in the front end of the compressor is substantially equal to that of the rear end of the compressor.

Figure 9:
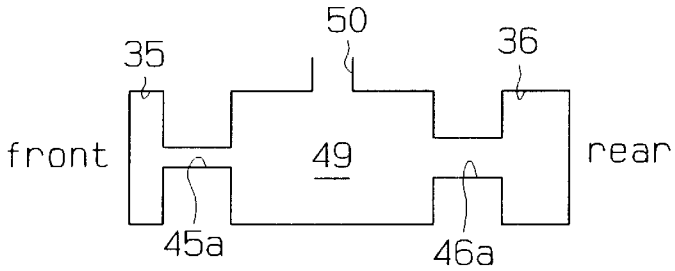
FIG. 9 is a diagrammatic view illustrating a mechanism for suppressing pulsation according to a third embodiment of the present invention.

(2) FIG. 9 shows a third embodiment of the present invention. In this embodiment, the volume of the front discharge chamber 35 is smaller than that of the rear discharge chamber 36. Also, the cross-sectional area of the front discharge passage 45*a* is smaller than that of the rear discharge passage 46*a*. The length of the front discharge passage 45*a* is equal to that of the rear discharge passage 46*a*.

The greater the volumes of the discharge chambers 35, 36 are, the greater the coefficient of expansion of refrigerant gas discharged to the chamber 35, 36 from the compression chamber 29A, 29B becomes, and the greater the rate of decrease of the pressure pulsation amplitude becomes. Further, as described above, the smaller the cross-sectional area of the discharge passage 45*a*, 46*a* is, the greater the rate of decrease of the pressure pulsation amplitude becomes. Therefore, in the third embodiment of FIG. 9, the rate of decrease of the pressure pulsation amplitude in the front end of the compressor is substantially equal to that of the rear end of the compressor.

Figure 10:
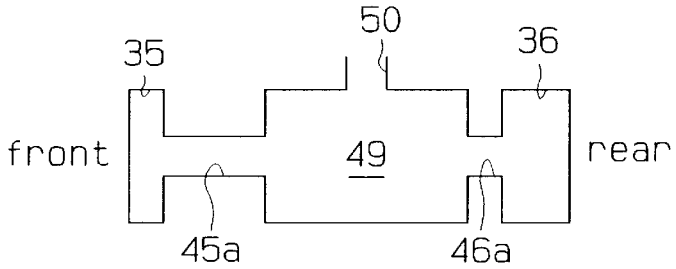
FIG. 10 is a diagrammatic view illustrating a mechanism for suppressing pulsation according to a fourth embodiment of the present invention.

(3) FIG. 10 shows a fourth embodiment of the present invention. In this embodiment, the volume of the front discharge chamber 35 is smaller than that of the rear discharge chamber 36, and the front discharge passage 45*a* is longer than the rear discharge passage 46*a*. The cross-sectional area of the front discharge passage 45*a* is equal to that of the rear discharge passage 46*a*.

As described above, the greater the volume of the discharge chamber 35, 36 is, the greater the rate of decrease of the pressure pulsation amplitude becomes, and the longer the discharge passage 45*a*, 46*a* is, the greater the rate of decrease of the pressure pulsation amplitude becomes. Therefore, in the fourth embodiment, the rate of decrease of the pressure pulsation amplitude in the front end of the compressor is substantially equal to that of the rear end of the compressor.

Figure 11:
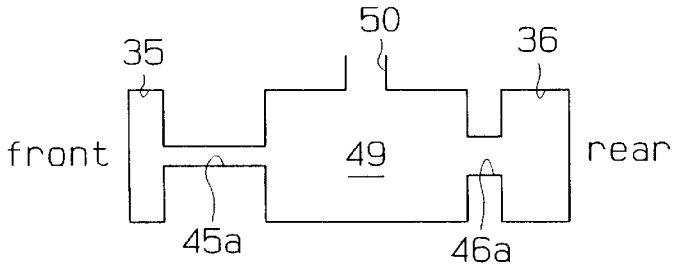
FIG. 11 is a diagrammatic view illustrating a mechanism for suppressing pulsation according to a fifth embodiment of the present invention.

(4) FIG. 11 shows a fifth embodiment of the present invention. In this embodiment, the volume of the front discharge chamber 35 is smaller than that of the rear discharge chamber 36. The front discharge passage 45*a* is longer than the rear discharge passage 46*a*, and the cross-sectional area of the front discharge passage 45*a* is smaller than that of the rear discharge passage 46*a*.

In this manner, the volume of the front chamber 35 and the length and the cross-sectional area of the passage 45*a* may be different from those of the rear chamber 36 and the rear passage 46*a* as long as the rates of decrease of the pressure pulsation amplitudes are the same between the front end and the rear end of the compressor.

Like the first embodiment, the second to fifth embodiments illustrated in FIGS. 8 to 11 eliminate five cycle components in the discharge pressure pulsation. Particularly, the fifth embodiment illustrated in FIG. 11 enables the volumes and shapes of the discharge chambers 35, 36 and of the discharge passages 45*a*, 46*a* to be altered in accordance with sizes and shapes of other parts of the compressor or in accordance with the size and shape of the space allocated for a compressor in an engine compartment. This makes the compressor of this invention more flexible and versatile.

(5) In the first to fifth embodiments, the oil separator 47 and the construction for supplying oil from the separator 47 to other parts such as bearings may be omitted. This simplifies the construction of the compressor.

(6) In the first to fifth embodiments, an even number such as two, four or six pairs of cylinder bores 27A and 27B may be defined in the cylinder blocks 21 and 22. In this case, it is preferable that the cylinder bores 27A, 27B be arranged about the axis of the drive shaft 38 with unequal intervals between each pair of adjacent bores 27A, 27B such that times at which refrigerant gas is discharged from each of the compression chambers 29A, 29B are all different from one another. This construction prevents peaks of two n-cycle components, which are merged in the discharge muffler 49, from being simultaneous. Accordingly, n-cycle components of pulsation are reduced and thus vibration and noise are suppressed.

(7) In the first to fifth embodiments, the number of the cylinder bores 27A, 27B in the cylinder blocks 21, 22 may be an odd number, such as three or seven, other than five.

(8) The present invention may be embodied in a variable displacement compressor of a double-headed piston type.

(9) The present invention may be embodied in a double-headed piston type compressor including a wave cam plate having a wavy cam surface instead of a swash plate.

Therefore, the present examples and embodiments are to be considered as illustrative and not restrictive and the invention is not to be limited to the details given herein, but may be modified within the scope and equivalence of the appended claims.

What is claimed is:

1. A compressor comprising:

a drive shaft;

a drive plate mounted on the drive shaft;

a plurality of first cylinder bores arranged around the drive shaft;

a plurality of second cylinder bores arranged around the drive shaft in corresponding alignment with the first cylinder bores, each second cylinder bore forming an aligned pair with a corresponding first cylinder bore;

a plurality of pistons operably connected to the drive plate, each piston being accommodated in one of the aligned pairs of cylinder bores, wherein the drive plate converts the rotation of the drive shaft to reciprocation of the pistons, wherein each piston compresses and discharges gas supplied to the associated first and second cylinder bores, and wherein the time at which gas is discharged from each cylinder bore is different from that of all of the other cylinder bores; and means for reducing the pulsation amplitudes of the gas discharged from both of the first and second cylinder bores at a substantially equal rate, wherein the reducing means includes:

a first discharge chamber for receiving the gas discharged from the first cylinder bores;

a second discharge chamber for receiving the gas discharged from the second cylinder bores;

a first discharge passage connected to the first discharge chamber for discharging the gas from the first discharge chamber; and a second discharge passage connected to the second discharge chamber for discharging the gas from the second discharge chamber, wherein the first and second discharge chambers have equal volumes, and the first and second discharge passages have equal lengths and equal cross-sectional areas.

2. The compressor according to claim 1, wherein the numbers of the first and second cylinder bores are each odd.

3. The compressor according to claim 2, wherein the axis of the first and second cylinder bores are spaced apart from one another at equal angular intervals about the axis of the drive shaft.

4. The compressor according to claim 1, wherein the compressor has a displacement that is within a range between approximately 100 cc and 200 cc, and the volume of each discharge chamber is within a range between 20 cc and 100 cc, the length of each discharge passage is within a range between 13 mm and 60 mm, and the diameter of each discharge passage is within a range between 7 mm and 12 mm.

5. A compressor comprising:

a drive shaft;

a drive plate mounted on the drive shaft;

a plurality of first cylinder bores arranged around the drive shaft;

a plurality of second cylinder bores arranged around the drive shaft in corresponding alignment with the first cylinder bores, each second cylinder bore forming an aligned pair with a corresponding first cylinder bore;

a plurality of pistons operably connected to the drive plate, each piston being accommodated in one of the aligned pairs of cylinder bores, wherein the drive plate converts the rotation of the drive shaft to reciprocation of the pistons, wherein each piston compresses and discharges gas supplied to the associated first and second cylinder bores, and wherein the time at which gas is discharged from each cylinder bore is different from that of all of the other cylinder bores; and means for reducing the pulsation amplitudes of the gas discharged from both of the first and second cylinder bores at a substantially equal rate, wherein the reducing means includes:

a first discharge chamber for receiving the gas discharged from the first cylinder bores;

a second discharge chamber for receiving the gas discharged from the second cylinder bores;

a first discharge passage connected to the first discharge chamber for discharging the gas from the first discharge chamber; and a second discharge passage connected to the second discharge chamber for discharging the gas from the second discharge chamber, wherein, either the discharge chambers have equal volumes, and the discharge passages have different lengths and different cross-sectional areas; the discharge passages have equal cross-sectional areas, and the discharge chambers have different volumes and the discharge passages have different lengths; or the discharge passages have equal lengths, and the discharge chambers have different volumes and the discharge passages have different cross-sectional areas.

6. The compressor according to claim 5, wherein the first and second discharge passages each have outlets that are close to and opposed to each other.

7. The compressor according to claim 6, wherein the compressor has a displacement that is within a range between approximately 100 cc and 200 cc, and the distance between the outlets of the discharge passages is within a range between 3 mm and 20 mm.

8. The compressor according to claim 6 further comprising an oil separator connected to the outlets of the discharge passages, wherein the oil separator separates lubricating oil from the gas discharged from the discharge passages.

9. The compressor according to claim 8 further comprising a discharge muffler for receiving the gas from the oil separator, wherein gas streams discharged from the discharge passages are merged in the discharge muffler through the oil separator.

10. The compressor according to claim 9, wherein the oil separator includes:

an oil separating chamber connected to the outlets of the discharge passages;

a pair of hollow cylinders located in the oil separating chamber and arranged to oppose each other, each cylinder having a distal end where the outlet of the discharge passage is located and a proximal end opposite to the distal end; and a communication passage located at position corresponding to the proximal end of each cylinder for connecting the oil separating chamber to the discharge muffler, wherein gas streams discharged into the oil separating chamber from the distal ends of the cylinders collide against each other and flow helically about the cylinders toward the communication passages.

11. A compressor comprising:

a drive shaft;

a drive plate mounted on the drive shaft;

an odd number of first cylinder bores arranged apart at equal angular intervals about the axis of the drive shaft;

an odd number of second cylinder bores arranged apart at equal angular intervals about the axis of the drive shaft in corresponding alignment with the first cylinder bores, each second cylinder bore forming an aligned pair with a corresponding first cylinder bore, a plurality of pistons operably connected to the drive plate, each piston being accommodated in one of the aligned pairs of cylinder bores, wherein the drive plate converts the rotation of the drive shaft to reciprocation of the pistons, wherein each piston compresses and discharges the gas supplied to the associated first and second cylinder bores, and wherein the time at which gas is discharged from each cylinder bore is different from that of all of the other cylinder bores;

a pair of reducing means, one reducing the pulsation amplitude of the gas discharged from the first cylinder bores and the other reducing the pulsation amplitude of the gas discharged from the second cylinder bores, wherein the reducing means reduce the amplitudes of the gas pulsations of the first and second cylinder bores at a substantially equal rate; and wherein each reducing means includes a discharge chamber for receiving the gas discharged from the associated cylinder bores and a discharge passage connected to the discharge chamber for discharging the gas from the discharge chamber, and wherein the discharge chambers of the reducing means have equal volumes, and the discharge passages of the reducing means have equal lengths and equal cross-sectional areas.

12. The compressor according to claim 11, wherein the compressor has a displacement that is within a range between approximately 100 cc and 200 cc, and the volume of each discharge chamber is within a range between 20 cc and 100 cc, the length of each discharge passage is within a range between 13 mm and 60 mm, and the diameter of each discharge passage is within a range between 7 mm and 12 mm.

13. The compressor according to claim 11, wherein the discharge passages of the reducing means each have outlets that are close to and opposed to each other.

14. The compressor according to claim 13, wherein the compressor has a displacement that is within a range between approximately 100 cc and 200 cc, and the distance between the outlets of the discharge passages is within a range between 3 mm and 20 mm.

15. The compressor according to claim 13 further comprising an oil separator connected to the outlets of the discharge passages, wherein the oil separator separates lubricating oil from the gas discharged from the discharge passages.

16. The compressor according to claim 15 further comprising a discharge muffler for receiving the gas from the oil separator, wherein gas streams discharged from the discharge passages are merged in the discharge muffler through the oil separator.

17. The compressor according to claim 16, wherein the oil separator includes:

an oil separating chamber connected to the outlets of the discharge passages;

a pair of hollow cylinders located in the oil separating chamber and arranged to oppose each other, each cylinder having a distal end where the outlet of the discharge passage is located and a proximal end opposite to the distal end; and a communication passage located at position corresponding to the proximal end of each cylinder for connecting the oil separating chamber to the discharge muffler, wherein gas streams discharged into the oil separating chamber from the distal ends of the cylinders collide against each other and flow helically about the cylinders toward the communication passages.

18. A compressor comprising:

a drive shaft;

a drive plate mounted on the drive shaft;

a plurality of first cylinder bores arranged around the drive shaft;

a plurality of second cylinder bores arranged around the drive shaft in corresponding alignment with the first cylinder bores, each second cylinder bore forming an aligned pair with a corresponding first cylinder bore;

a plurality of pistons operably connected to the drive plate, each piston being accommodated in one of the aligned pairs of cylinder bores, wherein the drive plate converts the rotation of the drive shaft to reciprocation of the pistons, wherein each piston compresses and discharges gas supplied to the associated first and second cylinder bores, and wherein the time at which gas is discharged from each cylinder bore is different from that of all of the other cylinder bores; and means for reducing the pulsation amplitudes of the gas discharged from both of the first and second cylinder bores at a substantially equal rate, wherein the reducing means includes:

a first discharge chamber for receiving the gas discharged from the first cylinder bores;

a second discharge chamber for receiving the gas discharged from the second cylinder bores;

a first discharge passage connected to the first discharge chamber for discharging the gas from the first discharge chamber; and a second discharge passage connected to the second discharge chamber for discharging the gas from the second discharge chamber, wherein the first and second discharge chambers have different volumes, and the first and second discharge passages have different lengths and different cross-sectional areas.

* * * * *